US005443181A

United States Patent [19]

Popp et al.

[11] Patent Number: 5,443,181

[45] Date of Patent: Aug. 22, 1995

[54] CARTRIDGE AND PISTON FOR DISPENSING MASS

[75] Inventors: Franz Popp, Buchloe, Germany; Hans Hüsler, Grabs, Switzerland

[73] Assignee: Hilti Aktiengesellschaft, Fürstentum Liechtenstein

[21] Appl. No.: 321,063

[22] Filed: Oct. 7, 1994

Related U.S. Application Data

[63] Continuation-in-part of Ser. No. 123,392, Sep. 17, 1993, abandoned.

[30] Foreign Application Priority Data

Sep. 19, 1992 [DE] Germany ..... 42 31 421.6

[51] Int. Cl.[6] ..... B65D 81/32; B65D 83/76

[52] U.S. Cl. ..... 222/95; 222/137; 222/327; 222/386; 222/386.5

[58] Field of Search ..... 222/95, 105, 94, 135, 222/137, 325, 326, 327, 386, 386.5

[56] References Cited

U.S. PATENT DOCUMENTS

| | | | |
|---|---|---|---|
| 1,263,590 | 4/1918 | Morrow | 222/386 |
| 1,265,533 | 5/1918 | Searle | 222/386 |
| 2,587,683 | 3/1952 | Barry | 222/327 X |
| 2,958,445 | 11/1960 | Jesse | 222/386 |
| 3,323,682 | 6/1967 | Creighton, Jr. et al. | 222/327 X |
| 4,236,516 | 12/1980 | Nilson | 222/95 X |
| 4,711,373 | 12/1987 | Christine | 222/386.5 X |
| 4,981,241 | 1/1991 | Keller | 222/137 |
| 5,137,177 | 8/1992 | Willis | 222/386 X |
| 5,184,757 | 2/1993 | Giannuzzi | 222/325 X |

FOREIGN PATENT DOCUMENTS

| | | | |
|---|---|---|---|
| 668126 | of 1926 | Australia | 222/326 |
| 0441538 | 8/1991 | European Pat. Off. | 222/326 |
| 8604041 | 7/1986 | WIPO | 222/326 |
| 92008670 | 5/1992 | WIPO | 222/326 |

*Primary Examiner*—Kevin P. Shaver
*Attorney, Agent, or Firm*—Anderson Kill Olick & Oshinsky

[57] ABSTRACT

A cartridge for use in an extension tool is arranged to receive one or more foil bags containing a single component or a multi-component mass and is formed of a cylinder (3) defining one or more receiving chambers (13) open at the opposite ends thereof. An axially displaceable piston (5) has opposite end faces (5b, 5c) extending across the cylinder (3) and each end face is symmetrical about its axis. The end faces of the piston can be used alternately for dispensing the mass out of the one or more foil bags.

8 Claims, 3 Drawing Sheets

CARTRIDGE AND PISTON FOR DISPENSING MASS

This is a continuation-in-part application of Ser. No. 08/123,392, filed Sep. 17, 1993, now abandoned.

BACKGROUND OF THE INVENTION

The present invention is directed to is directed to a cartridge for use in a dispensing tool and arranged to receive at least one foil bag containing a single component or a multi-component mass. The tool squeezes the mass out of the one or more bags. The cartridge has one or more axially elongated receiving chambers open at each end with plural chambers extending parallel to one another.

A single component or a multi-component mass, often used in buildings, motor vehicles, ships, aircraft, machines and numerous other apparatus, is at the present time supplied in so-called foil bags. The foil bags are hose-like containers particularly well-suited for pressing or squeezing-out the mass held in the containers. The advantage of such foil bags, after the mass has been completely squeezed out of the bag, is that all that remains is the compactly compressed foil of the bag. As distinguished from the other commonly used rigid containers, the volume of waste is considerably reduced.

Since these foil bags have no side stability relative to their axial direction, they must be inserted into so-called cartridges during the dispensing or squeezing-out operation and such cartridges have receiving chambers corresponding generally to the external diameter or external contour of the foil bags.

A device for squeezing material out of hose-like or bag-like containers, where the material is a viscous or pasty mass using conventional squeezing-out tools, is known from DE-GM 8 901 554. Such squeezing-out tools include a triggering lever and a cylindrical tubular member for receiving the containers, and a piston rod with a piston. When the triggering lever is operated, the piston rod is propelled forwardly and the piston presses the container and squeezes out its contents.

The known patent publication discloses that the piston must move through the cartridge with each new squeezing-out operation. The mechanical stress acting on the piston causes it to experience rapid wear. Furthermore, each time the hose-like or bag-like container is emptied, the piston and piston rod must be pulled back into its original position.

Due to the oversize of the piston, friction is generated between the piston and the inner wall of the cartridge receiving chamber during the return motion of the piston and this operation involves the exertion of unnecessary force on the part of the person operating the tool. Further, such friction produces additional mechanical stress on the wiping edge of the piston.

SUMMARY OF THE INVENTION

Therefore, it is the primary object of the present invention to provide a cartridge for a dispensing tool which squeezes out the material to be dispensed, so that there is a reduction in wear on the piston and a simpler and easier operation of the dispensing tool.

In accordance with the present invention, an axially displaceable piston is fitted in and in sliding engagement with the cylinder, whereby the opposite end faces of the piston can be used alternately for dispensing material with the end faces being symmetrical about the piston axis.

Such a cartridge including one piston in the one receiving chamber or in each of the plurality of receiving chambers receiving chambers can be arranged so that each time after a foil bag or bags have been completely emptied from one end of the cartridge, another foil bag or bags can be inserted into the other end. After a dispensing operation is completed, the cartridge is removed from the dispensing tool, the collapsed foil is pulled out of the cartridge, the ends of the cartridge are reversed relative to the piston rod, so that a new foil bag or bags can be inserted into the opposite end face of the cartridge.

During the dispensing operation, the piston has been axially displaced from one end toward the other and the previously rear end face not in contact with the foil bag or bags now forms the end face contacting the new foil bags inserted into the cartridge. This arrangement is advantageous, since the foil bag or bags can be simply placed into the cartridge without any concern that they will fall out of the opposite end from which they are inserted.

The piston located in the cartridge can be acted upon in its central region at both of its end faces. Accordingly, after each dispensing operation a different end face of the piston acts on the foil bag or bags to be emptied. A particular advantage of the cartridge of the present invention is that the piston is located in the cartridge and does not need to be displaced axially through the cartridge after each complete dispensing operation.

With regard to the ease of operation of the dispensing tool with the new cartridge, it should be noted that the piston rod can be pulled back to the original position without any frictional resistance, since the end of the piston rod does not carry the piston, rather it merely applies pressure to the central region during the dispensing operation.

It the cartridge becomes soiled due to a damaged foil bag, when the piston rod is retracted, the soiled portion is not pulled into the dispensing tool by the piston, rather the cartridge along with the damaged foil bag and the piston is removed from the tool and thrown away.

By locating the piston in the cartridge it is assured that the replacement of a repeatedly used piston, damaged by mechanical wear, occurs by the disposal of the cartridge along with the damaged piston. A time-consuming replacement of the piston on the piston rod by means of suitable tools is eliminated.

Preferably, the piston is formed of at least two parts each forming a symmetrical end face. The fabrication of such a piston for the cartridge is economical, since the piston parts can be more easily formed. Depending upon the mass to be dispensed, the piston may have thin or thick walls as well as a specific shape of the end face engaging the foil bag or bags. In particular with such a piston, it is sensible to form the piston of two identical symmetrical parts installed together into the cartridge in such a way that the end faces are directed in opposite directions. The two parts of the piston can be placed in the cartridge without the necessity of fixing the parts together. Preferably, the piston around its circumference has lugs extending in the axial direction of the piston. Such lugs have the advantage that the entire circumference of the piston does not rest at the inner wall of the receiving chamber. The wipe-off of the foil material from the inner surface is nevertheless assured and the friction arising during axial movement of the piston is greatly diminished.

The receiving chambers formed in the cartridges expediently include passages which, as a rule, are shaped as grooves along the outer surface of the chambers, with the grooves extending in the axial direction and cooperating with lugs or projections on the circumference of the pistons so that the projections fit into the grooves. This arrangement ensures a very high positional stability for the piston in the receiving chamber, since the piston cannot tilt or become jammed in the receiving chamber. By forming narrow grooves it prevents the foil bag in the receiving chamber from penetrating into the grooves. The projections on the piston can engage into the narrow grooves and effect a good bearing action on the foil bags.

With such an arrangement of the receiving chambers and pistons there is the further advantage that turning of the piston within the receiving chamber is impossible. As a result, helical twisting of the foil bag in the receiving chamber during the squeezing-out operation can be prevented.

Preferably, the receiving chambers have a circular cross-section. Since the manufacture of foil bags shaped as hoses is simple and economical, the receiving chambers are particular effective with a circular cross-section. The piston can also be fabricated economically with an essentially circular cross-section transversely of the axial direction of the chambers.

The receiving chambers can have different volumes. Depending on the characteristic of each application, whether a single or multi-component mass is used, certain mixing ratios are necessary and are achieved by at least two different components being simultaneously squeezed out of receiving chambers of different sizes.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
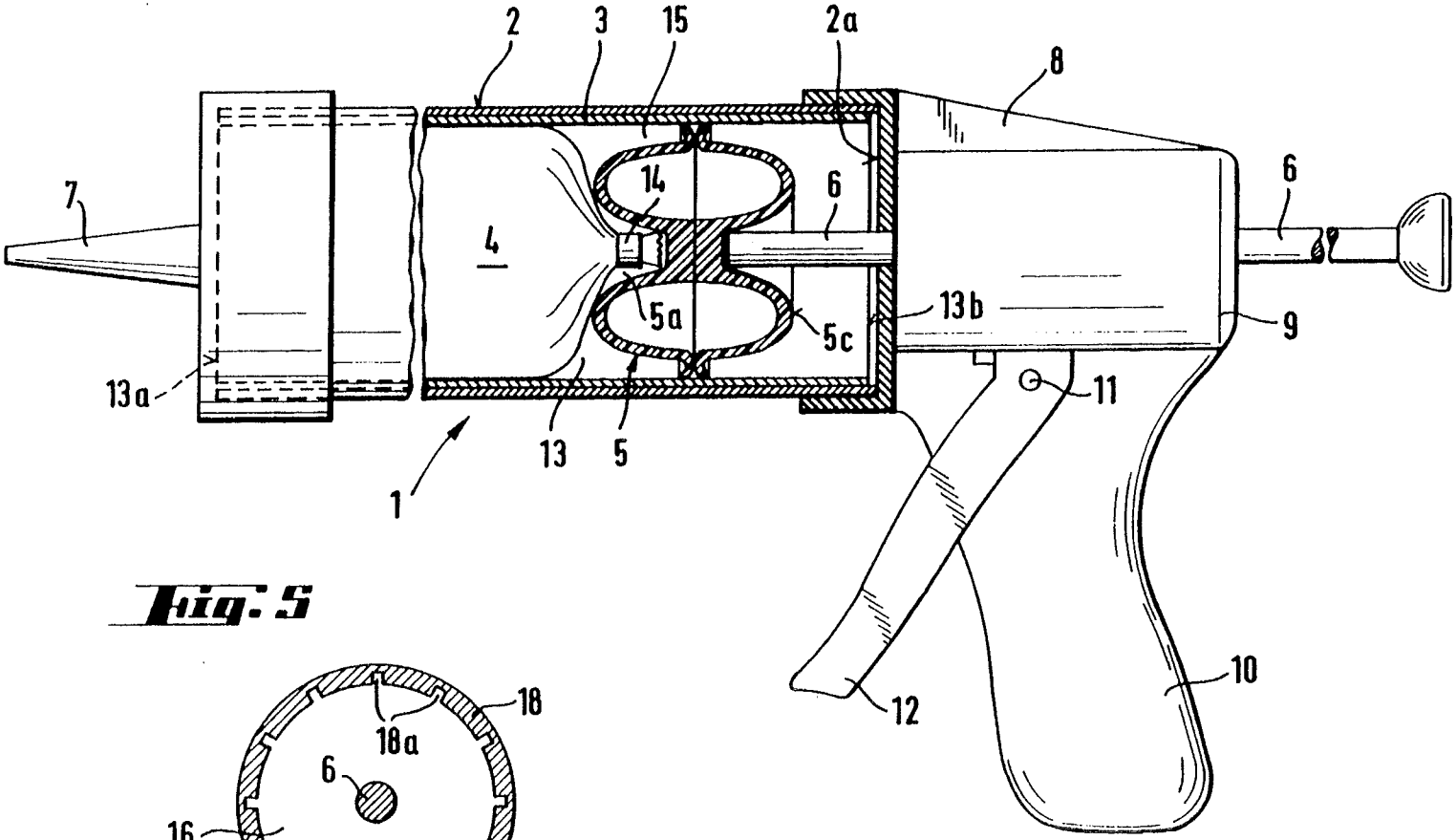
FIG. 1 is a side view, partly in section, of a commercially available dispensing tool with a cartridge embodying the invention inserted into the tool.

In FIG. 1 a dispensing tool 1 is shown for squeezing a material out of a container. The tool 1 has an axially extending tubular portion 2 in which a similarly axially extending cylinder or cartridge 3 is inserted. A foil bag 4 filled with a single component or a multi-component mass is inserted into the cartridge. The cylinder or cartridge 3 contains an axially displaceable piston 5 with two oppositely directed end faces **5*b*, 5*c* symmetrical about the axis of the cartridge. The piston can be axially displaced from either side by a piston rod 6 bearing against the axial center of the piston 5. At the left hand end of the tool 1 is a nozzle 7 through which the mass is squeezed out of the tool. As the piston presses against the foil bag 4**, the mass within it is fed in a metered manner through the nozzle to a processing location, not shown.

At the opposite end of the cartridge from the nozzle 7 there is a housing member 8 fitted on a rear end **2*a* of the tubular portion 2. Housing 8 contains the entire feeding or advancing mechanism 9 of the dispensing tool 1. A piston rod 6 extends through the housing and is axially displaced into the cartridge 3 by the feed mechanism 9. The housing 8 has a handle part 10 containing a triggering lever 12 pivotally fastened at an axis 11 in the upper part of the handle 10**.

The inner surface of the cylinder or cartridge 3 defines a receiving chamber 13 open at its opposite end faces **13*a*, 13*b*. The axial length of the cartridge 3 is matched to the foil bag 4 located in the chamber and to the axial length of the piston 5 and, if necessary, to the axial length of a fully collapsed or compressed foil bag when one of the end faces 13*a*, 13*b*** completes the dispensing operation.

Piston 5, located in the cartridge 3, is shaped to correspond to the adjacent end surface of the foil bag 4. In addition, in its axial center, the piston has a recess **5*a* for receiving a closing element 14 in the shape of a clip. Laterally encircling the piston 5 is a free space 15 which serves to receive the collapsed or compressed foil bag 4. Piston 5 located in the receiving chamber 13 is made up of two parts and the piston rod 6** can bear against the central region of each of the end faces.

Figure 2:
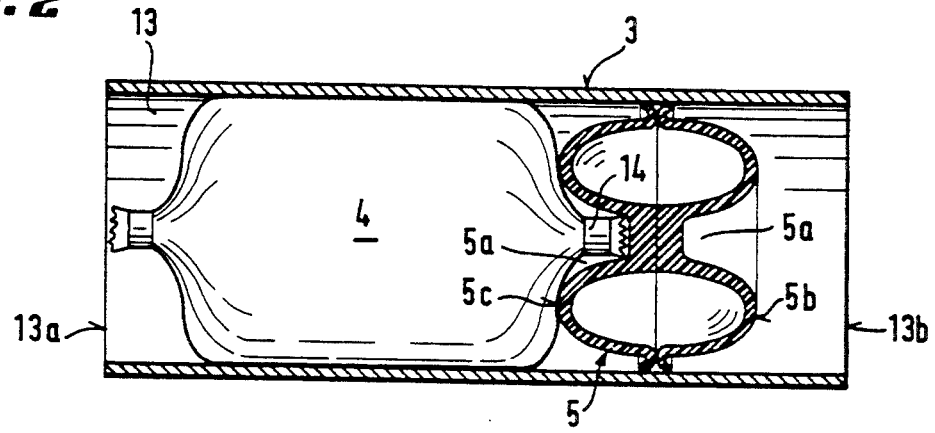
FIG. 2 is an axially extending sectional view of the cartridge shown in FIG. 1.

In FIG. 2 a cylinder or cartridge 3 is shown without the dispensing tool 1 with the piston 5 located in the initial end position. The piston is axially displaceable through the cartridge 3 and can be displaced from both ends of the cartridge to other opposite end. Cartridge 3 contains a full foil bag 4. In the arrangement shown in FIG. 2, the cartridge 3 can be inserted into a dispensing tool 1 so that the right hand end face of the piston faces the piston rod 6.

Figure 3:
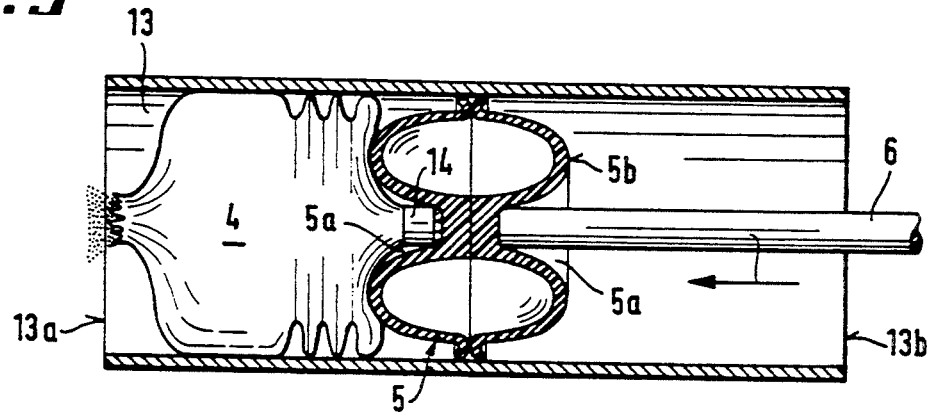
FIG. 3 is a view similar to FIG. 2 with half of the contents of the foil bag in the cartridge squeezed out.

In FIG. 3 the cartridge 3, as shown in FIG. 2, has been acted upon by the piston and half of its contents has been squeezed-out by the dispensing tool 1. Piston 5 is located approximately midway in the receiving chamber 13 between the ends **13*a*, 13*b* and the contents of the foil bag have been partially squeezed-out and, as can be noted, an axial portion of the foil bag 4** has been compressed or collapsed.

Figure 4:
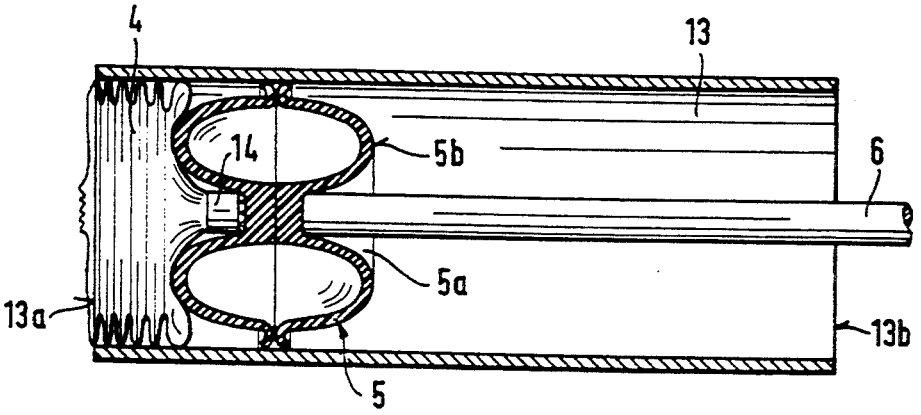
FIG. 4 is a sectional view similar to FIGS. 2 and 3 with the contents of the foil bag completely squeezed-out.

FIG. 4 shows the same cylinder or cartridge 3 as in FIGS. 2 and 3, but after the squeezing-out of the mass has been completed and with the cartridge 3 removed from the dispensing tool 1. The foil bag 4 is in the completely collapsed condition in the region of the receiving chamber end face **13*a* with one of its ends bearing against the piston 5. After the collapsed foil bag has been removed, and the piston rod removed, a new filled foil bag 4 can be inserted through the opposite end face 13*b* into the larger space of the receiving chamber 13. Care must be taken when reinserting the cartridge 3 into the dispensing tool 1 that it is turned through 180° so that the piston rod 6 presses against the center of the piston 5 and not against the foil bag 4 when the advancing mechanism 9** is actuated.

Foil bag 4 can be connected to the nozzle 7, as shown in FIG. 1, at its dispensing end. The nozzle projects beyond the receiving chamber 13 of the cartridge 3 if a foil bag 4 is inserted into the cartridge.

The cartridge 3 as shown in FIGS. 1 to 4 can be made up of several receiving chambers 13 each contacted by a respective piston 5. The volume of each of the receiving chambers 13 can be of the same size or of different sizes.

Figure 5:
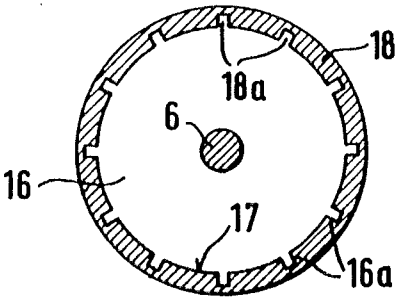
FIG. 5 is a transverse sectional view of another cartridge embodying the present invention.

FIG. 5 is a transverse cross-section of another cylinder or cartridge 18 in which a piston 16 is inserted. Piston 16 has outwardly projecting lugs 16a extending into matching grooves 18a in the inner surface 17 of the receiving chamber. A high positional stability of the piston 16 in the receiving chamber of the cartridge 18 is achieved by the interengaging arrangement of the lugs 16*a* and the grooves 18*a*. Piston 16 has symmetrically arranged end faces, not shown in the this Figure.

Figure 6:
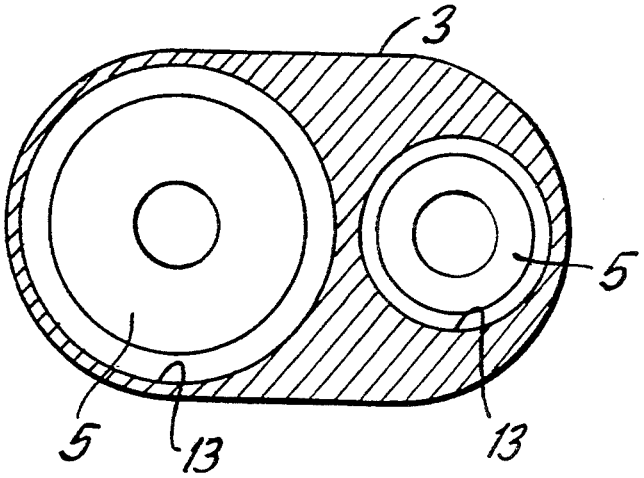
FIG. 6 is a cross sectional view of the cartridge, showing receiving chambers of different volumes.

FIG. 6 depicts a cross-section view through a cartridge 3, comprising a large and a small receiving chamber 13. Both receiving chambers 13 extend parallel to each other and have different volumes. Pistons 5 are arranged in the receiving chamber 13, which can be axially displaced by means of piston rods (not shown here).

While a specific embodiment of the invention has been shown and described in detail to illustrate the inventive principles, it will be understood that the invention may be embodied otherwise without departing from said principles.

We claim:

1. A replaceable cartridge for use in a dispensing tool having a mechanism for dispensing a component mass comprising at least one component out of foil bags received in said cartridge, said cartridge comprising:

an axially extending housing having open opposite ends;

a plurality of juxtaposed chambers extending between said open opposite ends and having different volumes for receiving a respective plurality of component mass-containing foil bags having different sizes, said receiving chambers having respective inner surfaces defining the respective different volumes of said receiving chambers; and a plurality of pistons corresponding in number to the plurality of receiving chambers and having different cross-sections corresponding to the different volumes of the receiving chambers, each of the plurality of pistons being axially displaceable in a sliding engagement with an inner surface of a respective receiving chamber, and each of the plurality of pistons having opposite end faces extending across a respective receiving chamber and being symmetrical with respect to a cross-section of the respective chamber, whereby each of said opposite end faces can be alternatively acted upon by the dispensing mechanism of the dispensing tool for displacing the piston in the respective chamber to squeeze a component mass out of a respective foil bag.

2. The cartridge, of claim 1, wherein each of said pistons comprises at least two similar parts, each part having a symmetrically arranged end face.

3. The cartridge of claim 2, wherein each of said pistons has projecting lugs extending in the axial direction around its circumferential periphery.

4. The cartridge of claim 3, wherein the inner surface of each chamber has axially extending grooves therein having a configuration corresponding with the lugs of a respective piston.

5. The cartridge of claim 3, wherein each receiving chamber has a circular cross-section.

6. The cartridge of claim 3, wherein said end faces of each piston have a half oval configuration.

7. The cartridge of claim 6, wherein each of said end faces has a central recess arranged to receive a piston rod of the dispensing mechanism.

8. The cartridge of claim 7, wherein each piston is formed of two similarly shaped parts, each of said parts forming one of said end faces.

* * * * *